US011670263B2

(12) United States Patent
McCormick

(10) Patent No.: US 11,670,263 B2
(45) Date of Patent: Jun. 6, 2023

(54) FULCRUM TREMOLO SPRING LOCKING CLAW AND CLAW RESONATOR PLATE

(71) Applicant: Lance Robert McCormick, Chatsworth, CA (US)

(72) Inventor: Lance Robert McCormick, Chatsworth, CA (US)

( * ) Notice: Subject to any disclaimer, the term of this patent is extended or adjusted under 35 U.S.C. 154(b) by 173 days.

(21) Appl. No.: 17/084,311

(22) Filed: Oct. 29, 2020

(65) Prior Publication Data

US 2022/0139360 A1 May 5, 2022

(51) Int. Cl.

| | |
|---|---|
| ***G10D 3/153*** | (2020.01) |
| ***G10H 3/18*** | (2006.01) |
| ***G10D 3/06*** | (2020.01) |
| ***G10D 3/12*** | (2020.01) |
| ***G10D 1/08*** | (2006.01) |
| ***G10D 3/22*** | (2020.01) |

(52) U.S. Cl.

CPC ..... *G10D 3/153* (2020.02); *G10D 1/085* (2013.01); *G10D 3/06* (2013.01); *G10D 3/12* (2013.01); *G10D 3/22* (2020.02); *G10H 3/18* (2013.01); *G10H 2220/461* (2013.01)

(58) Field of Classification Search

CPC ..... G10D 3/153; G10D 1/085; G10D 3/06; G10D 3/12; G10D 3/22; G10H 3/18; G10H 2210/211; G10H 2220/461

See application file for complete search history.

(56) References Cited

U.S. PATENT DOCUMENTS

| | | | | |
|---|---|---|---|---|
| 3,599,524 A | | 6/1971 | Jones | |
| 4,135,426 A | | 1/1979 | Richard | |
| 4,171,661 A | | 10/1979 | Rose | |
| 4,201,108 A | | 5/1980 | Bunker | |
| 4,206,679 A | | 6/1980 | Wilson | |
| 5,477,765 A | * | 12/1995 | Dietzman | G10D 3/153 84/313 |
| 5,783,763 A | * | 7/1998 | Schaller | G10D 3/153 84/313 |
| 8,536,430 B2 | | 9/2013 | McCabe | |
| 10,643,587 B1 | | 5/2020 | McCormick | |

* cited by examiner

*Primary Examiner* — Daniel J Colilla

(57) ABSTRACT

Sonic improvement for all stringed instruments that employ a fulcrum tremolo bridge system with back of instrument counter tensioning springs. The improvement is provided by securing springs to claw assembly, as well as securing claw assemble to a flat plate of material which is in turn secured to instrument body. The claw and resonator plate can be fabricated as two individual pieces then fastened together or as a combined one piece assemble that is then fastened to instrument body.

11 Claims, 3 Drawing Sheets

FULCRUM TREMOLO SPRING LOCKING CLAW AND CLAW RESONATOR PLATE

FEDERALLY SPONSORED RESEARCH

Not Applicable

SEQUENCE LISTING OF PROGRAM

Not Applicable

FIELD OF INVENTION

This invention relates to a volume, sustain, and frequency response improvement for guitars and stringed musical instruments consisting of a body, neck, and plurality of strings under tension employing a fulcrum tremolo string bridge system.

BACKGROUND OF INVENTION

Stringed musical instruments, such as the electric guitar, have featured an option since the 1950's called a tremolo. It is a fulcrum point string bridge located on instrument body face that allows performer to lower or raise the pitch of all strings simultaneously. The most widely employed type of fulcrum tremolo system generates the needed string counter tension via a plurality of springs located in a cavity on back of instrument body. One end of the plurality of springs is attached to the bottom portion of the bridge called the "block" and the other to a piece of flanged steel called the "claw". The claw is secured to guitar body via two wood screws to the spring cavity wall opposite that of bridge block. The two screws allow for tension adjustment of Tremolo System. The drawback to current tremolo system is the lack of mechanical coupling strings have with instrument body. The screw heads and bridge fulcrum points alone fail to realize the vibrating strings full potential for sound wave transfer; there by attenuating the frequency response, amplitude, and sustain of sound waves resonating into instrument body and neck.

SUMMARY OF INVENTION

These matters were initially addressed in my Fulcrum Tremolo Claw Lock Resonator U.S. Pat. No. 10,643,587 B1. Continued development on the principal system has yielded addition methods of improving frequency response, amplitude, and sustain of the vibrating string(s) into instrument body and neck.

The first improvement was realized in the development of a "spring locking claw". By redesigning the current industry standard "claw" so that the flanged steel spring retaining posts are substituted by a compression generating spring retaining post screw assembly, that change instituted a instrument wide sonic improvement. In the standard flange metal claw design the tremolo system counter tensioning springs are simply hooked on to the, finger like, flange steel posts and secured in position via the tension generated by the instrument's strings, that method presents only minimal surface area at connection point for sound wave energy to be transferred between "springs" and "claw", the "spring locking claw" design allows the "springs" to be compression coupled to the face of "claw" via screw assemble creating far more surface area between components for resonance coupling to occur. The added necessity of employing a material thick enough to be drilled and tapped for the screws to function as spring retaining posts increased the "claw" components general mass, that mass increase to instrument's core proved to be of added tonal benefit.

The second improvement was realized via a new fabrication method for the "Fulcrum Tremolo Claw Lock Resonator" U.S. Pat. No. 10,643,587 B1 in which the "resonator plate" and "claw" are constructed as a single piece. The needed tremolo system spring/string counter tensioning adjustments are still arrived at in the traditional way, via the two large "claw" retaining screws, located opposite side of tremolo spring cavity from "bridge block". The marriage of "resonator plate" and "claw" allows for a simplified method of fabrication yet still achieves the sound wave energy coupling benefits present in the two piece "Claw Lock Resonator" fabrication method. A necessity was found in this new one piece design requiring "repositioned and elongated" mounting screw slots. Those mounting screw slot changes were needed to allow for adjustment "set up" of the tremolo system before securing the "Claw Resonator Plate" to spring cavity wood surface for maximum string resonance coupling into guitar body and neck.

DISCLOSURE OF DETAILED DESCRIPTION OF THE PREFERRED EMBODIMENT

Figure 1:
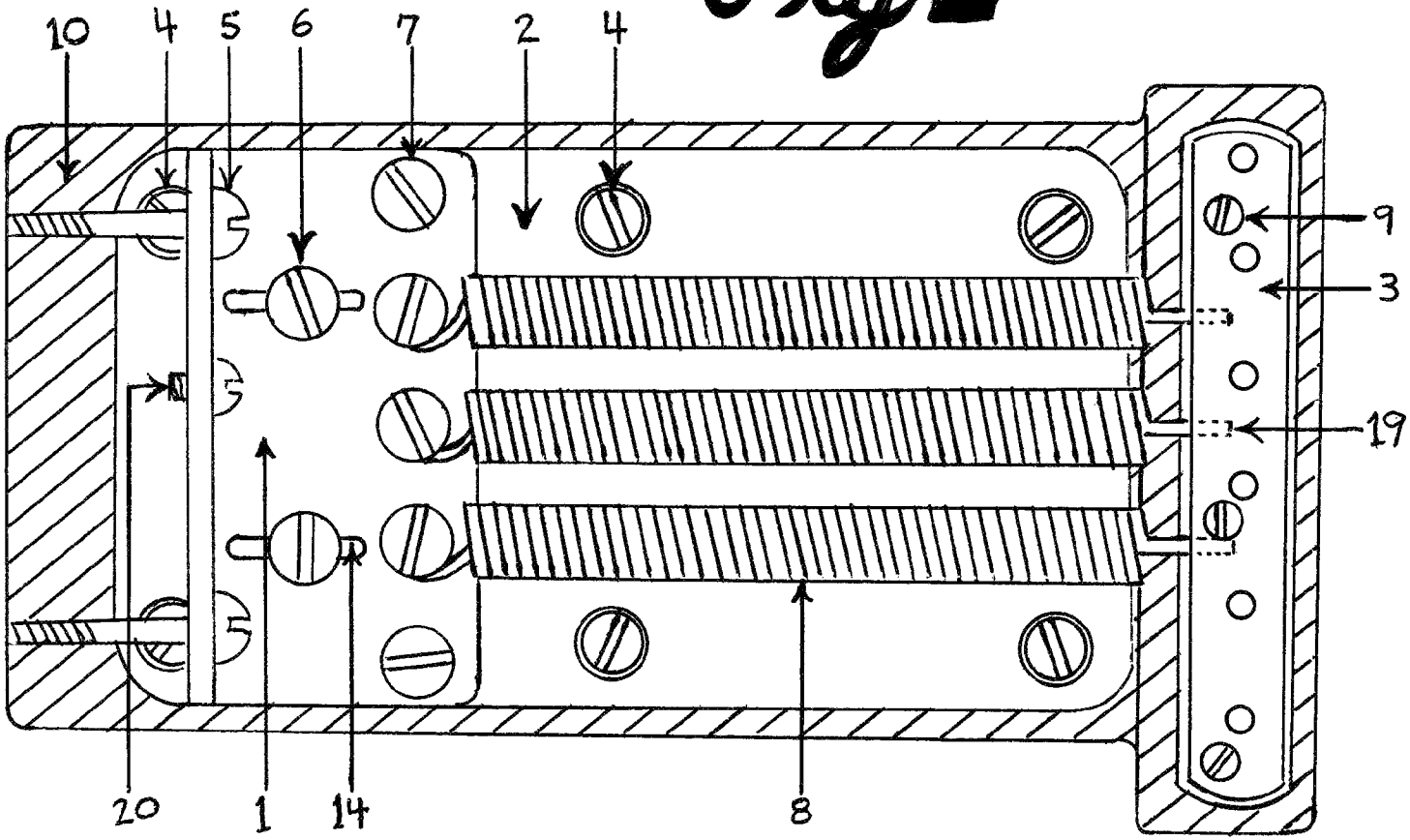
FIG. 1 is a top view of spring counter tensioning cavity on back of guitar that employs a fulcrum tremolo system.

Other objects, features, and advantages will occur from the following description of a preferred Embodiment and the accompanying drawings, in which:

FIG. 1 demonstrates the Fulcrum Tremolo Spring Locking Claw 1, counter tensioning spring retaining post machine screw assembly 7, counter tensioning adjustment screws 5, resonator plate 2, mounting to body screws 4, claw to resonation plate bonding machine screws 6, claw to resonator plate bonding screw slots 14, fulcrum tremolo spring locking bridge block spring securing plate 3, mounting to bridge block machine screws 9, fulcrum tremolo counter tensioning springs 8, guitar's counter tensioning spring cavity 10, small cavity in bridge block for securing tensioning spring end 19, machine screw for electronic grounding 20.

Figure 2:
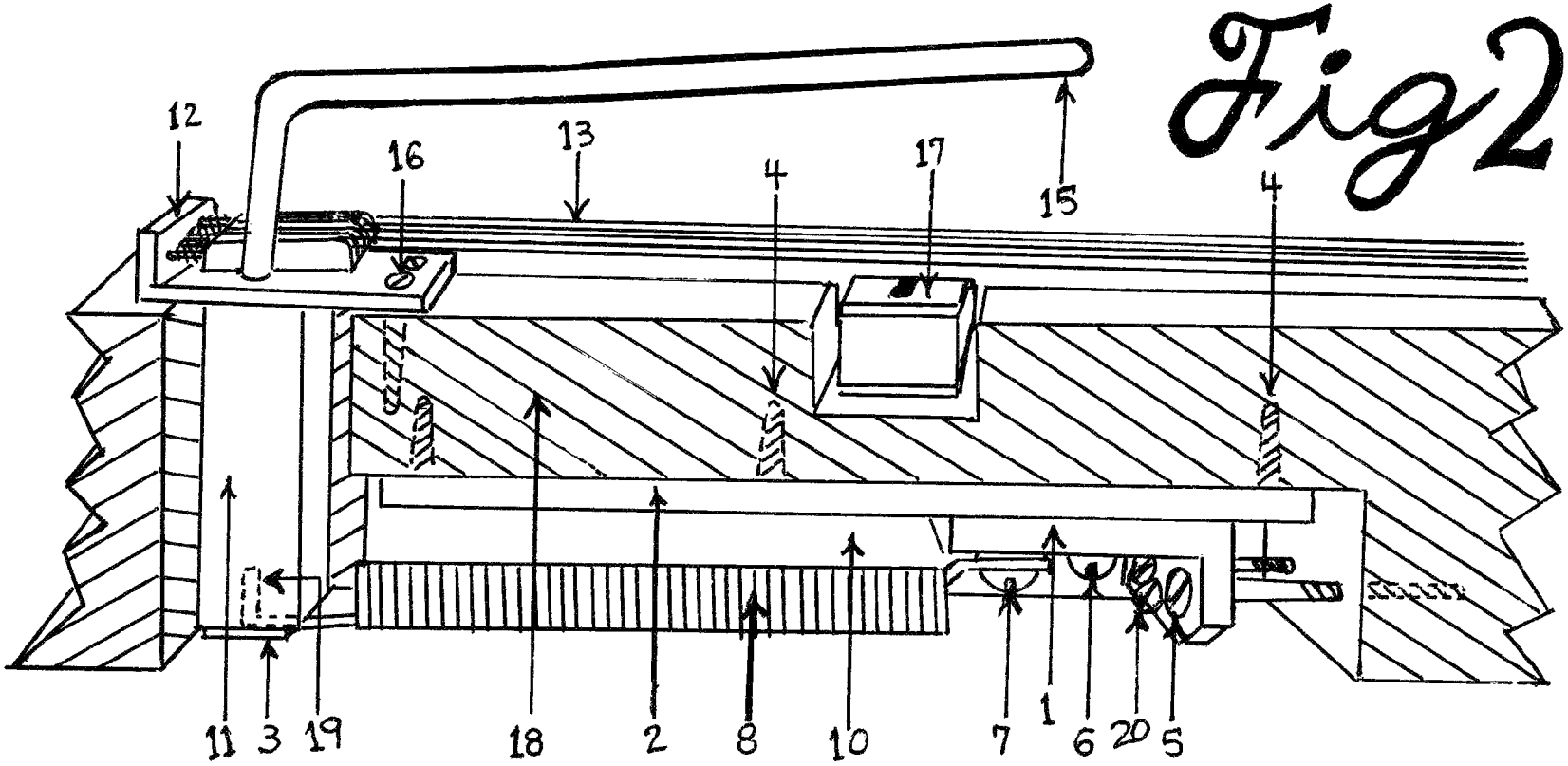
FIG. 2 is a side cut away view of an electric guitar employing a fulcrum tremolo spring bridge.

FIG. 2 demonstrates the guitar body 18, the strings 13, the electromagnetic pickup 17, the arm to activate tremolo 15, bridge platter and string saddles 12, bridge mounting screws and fulcrum point 16, bridge block 11, fulcrum tremolo spring locking bridge block spring securing plate 3, Fulcrum Tremolo Spring Locking Claw 1, counter tensioning spring retaining post machine screw assembly 7, resonation plate 2, mounting to body screws 4, claw to resonator plate bonding machine screws 6, counter tensioning adjustment screws 5, fulcrum tremolo counter tensioning springs 8, tremolo spring counter tensioning cavity 10, hole in bridge block for securing tensioning spring end 19, machine screw 7 is demonstrating the replacement of a flanged steel claw spring retaining post. This modification allows for increased surface contact area between spring 8, and claw face 1, and is also secured under the compression provided by head of machine screw 7.

Figure 3:
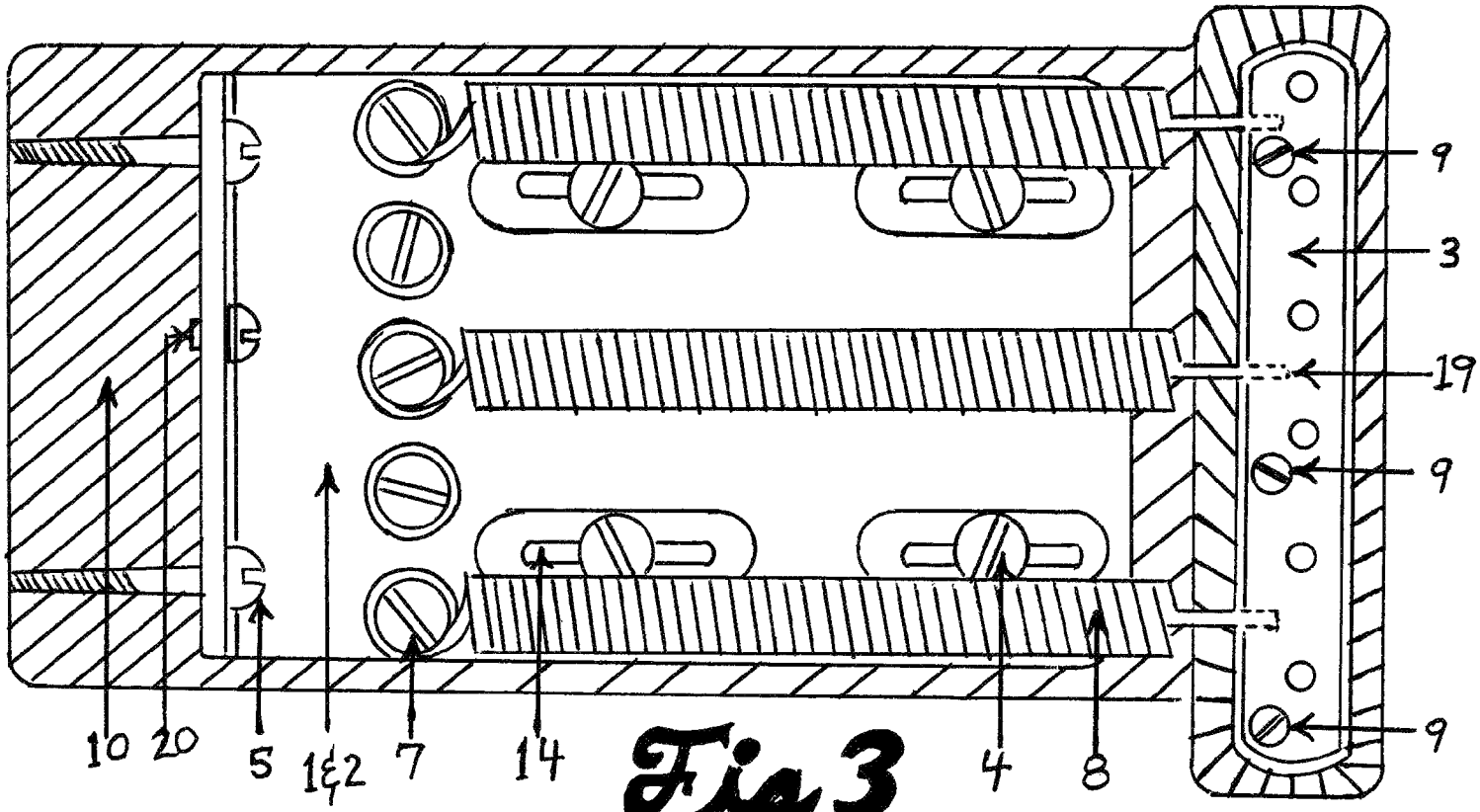
FIG. 3 is a top view of spring counter tensioning cavity on back of guitar that employs a fulcrum tremolo system.

FIG. 3 demonstrates the "Claw Resonator Plate" 1&2, counter tensioning spring retaining post machine screw assembly 7, counter tensioning adjustment screws 5, mounting to body screws 4, elongated mounting to body screw slot 14 spring securing plate 3, mounting to bridge block machine screws 9, fulcrum tremolo counter tensioning springs 8, tremolo spring cavity 10, small cavity in bridge block for securing tensioning sprint end 19, machine screw for electronic grounding 20, the Claw Resonator Plate 1&2, attached to spring cavity 10, via screws 4, through slots 14, and counter tension adjustment screw 5, tremolo system counter tension springs 8, attaches to claw resonator plate 1&2, via machine screw 7.

FIG. 3 demonstrates the claw and resonator plate made in one piece, "Claw Resonator Plate" 1&2, counter tensioning spring retaining post machine screw assembly 7, counter tensioning adjustment screws 5, mounting to body screws 4, elongated mounting to body screw slot 14, spring securing plate 3, mounting to bridge block machine screws 9, fulcrum tremolo counter tensioning springs 8, tremolo spring cavity 10, small cavity in bridge block for securing tensioning spring end 19, machine screw for electronic grounding 20, the Claw Resonator Plate 1&2, attaches to spring cavity 10, via screws 4, through slots 14, and counter tension adjustment screw 5, tremolo system counter tension springs 8, attaches to claw resonator plate 1&2, via machine screw 7.

The Fulcrum Tremolo Spring Locking Claw and Claw Resonator Plate can be retrofitted or original equipment on any stringed musical instrument with a fulcrum tremolo system that employs back of instrument body spring counter tensioning method most commonly used in electric guitar manufacturing. These items can be combined in a retro fit kit or sold as separate items to be employed individually. A complete two piece retro fit kit would include a Fulcrum Tremolo Spring Locking Claw 1, machine screws 6 and 7, Claw Lock Resonator plate 2, with mounting screws 4, or a single piece kit with the Claw Resonator Plate 1&2 combination and screws 7 and 4.

The instrument with the fulcrum tremolo string bridge system will be sonically improved by the addition of a Fulcrum Tremolo Spring Locking Claw or Claw Resonator Plate, these components provide expanded surface area and increased mass capable of transferring sound wave energy in the core of string instrument more effectively and efficiently, so that amplitude, sustain, and frequency response are all improved. With enhanced frequency coupling of the fulcrum tremolo system to instrument core, the entire range of pitches and over tone harmonics the instrument can produce are audibly improved.

The presence of these inventions enhances low frequency response to the human ear, interpreted as a warmer sound, a richer sound, and a sound that needs less electronic processing to convey musical pleasure as perceived by our ears.

The securing of the counter tensioning springs of a fulcrum tremolo system to the Claw Resonator Plate or to a Spring Locking Claw and then to a Resonator Plate eliminates completely the potential of movement as found in the industry standard flanged metal claw, secured only by two screws, when tremolo is activated by player, thereby improving instrument tremolo systems tuning accuracy in returning to the non-pitch varied position of the tremolo bridge. Increasing the mass of the instrument body with the addition of a Spring Locking Claw or Claw Resonator Plate in the center or core of the instrument allows the instrument to more efficiently resonate sound energy outward to exterior edges of guitar body and neck.

The invention claimed is:

1. A stringed musical instrument comprising: a solid resonating body; a neck; a fulcrum tremolo string bridge system disposed in a cavity of said solid resonating body, said fulcrum tremolo string bridge system comprising: a resonator bridge block in said cavity of said solid resonating body, wherein the resonator bridge block is pivotally movable in the cavity; a claw bracket mounted in the cavity; a plurality of tremolo tension springs, each tension spring have a first end and a second end, said plurality of tremolo tension springs disposed in a spring portion of the cavity of the solid resonating body, wherein said first end of each tension spring is mounted to the resonator block, and said second end of each tension spring is mounted to the claw bracket with respective screw compression coupling; and fasteners securing the claw bracket to a flat plate of a material which in turn is secured to the solid resonating body.

2. The stringed musical instrument of claim 1, wherein the screw compression couplings secure said springs to a face of the claw bracket, whereby, under compression, each second end of each tension spring creates a more efficient pathway for sound wave energy to transfer through and into said solid resonating body and said neck.

3. The stringed musical instrument of claim 1, wherein the claw bracket has an L-shape including an upright and horizontal part, wherein the upright of the L-shape has screw holes and the horizontal part has slotted screw holes and a row of five spring retaining screw holes, where a screw through the upright of the L-shape mounts the claw bracket to the solid resonating body and the horizontal part of the L-shape has a screw through the slots into the flat plate of material, wherein each screw compression coupling is inserted into a respective one of the row of five spring retaining screw holes thereby securing a respective end of each of the tension springs.

4. The stringed musical instrument of claim 3, wherein the spring portion of the cavity is bounded by inset walls and the resonator block is housed in another portion of the cavity wherein the claw bracket is mounted to one of the said inset walls at a location opposite to said another portion of the cavity, wherein screws extend from the upright of the L-shaped claw bracket into said one of said inset walls.

5. The stringed musical instrument of claim 3, wherein the L-shaped claw bracket is attached to the flat plate of material via adhesive or screw slots on the horizontal portion of said L-shaped claw bracket yielding a tonal stringed instrument wide improvement.

6. The stringed musical instrument of claim 1, wherein a depth of cavity is oriented into the solid resonating body from a rear surface of the body of the stringed instrument, and there is a recess in a front surface of the body above the recess housing a plurality of instrument pick-ups and where in a longitudinal axis of the spring portion of the cavity is parallel to strings of the stringed instrument.

7. The stringed musical instrument of claim 1, where the flat plate of material comprises a magnetic material, the stringed instrument is electrified by magnetic pickups, and the claw bracket and flat plate of material are mounted from a rear surface of the stringed instrument body.

8. The stringed musical instrument of claim 1, wherein the flat piece of material is attached to said stringed instrument body with screws or adhesive agent to an innermost surface of the cavity which is located in a rear surface of the stringed instrument body in parallel with a face of the stringed instrument.

9. The stringed musical instrument of claim 1, wherein the flat plate of material is a metal or a non-metal, selected according to the desired sound modification characteristic.

10. A fulcrum tremolo spring system retro fit kit for a stringed instrument, comprising: a spring claw assembly and resonator plate combination fabricated as a single plate of metal that mounts to a spring claw assembly mount wall in a spring mount cavity of said stringed instrument, wherein the spring claw assembly and resonator plate combination includes: a plurality of tension springs; a plurality of screw slots; a machine screw respectively inserted into each slot of the plurality of screw slots thereby securing said spring claw assembly and resonator plate combination to a body of the stringed instrument; five threaded spring retaining post holes; five machine screw configured as spring retention posts; one machine screws is configured as an electrical ground wire, wherein each of said tension springs have a first end and a second end wherein each first end of said tension springs is secured to spring claw assembly and resonator plate combination with selected ones of the five machine screws, wherein the single plate of metal is disposed under said tension springs, wherein said resonator plate and said spring claw assembly combination further comprising an L-shape with an upright on an end opposite that of a resonator block of said stringed instrument, and wherein each second end of said tension spring is secured to the resonator block by a spring securing plate which is secured to the resonator block with a plurality of screws.

11. The fulcrum tremolo spring system retro fit kit for stringed musical instrument, according to claim 10, wherein the single plate of metal is magnetic and is mounted on a rear surface of said body opposite a location of electromagnetic pickups disposed on a front surface of the body.

* * * * *